US005718071A

United States Patent [19]

Zbriger

[11] Patent Number: 5,718,071

[45] Date of Patent: Feb. 17, 1998

[54] STEAM IRON WITH STEAM CHAMBER RAMP, PUDDLE CONTAINMENT, AND SURGE DRYING WALL

[75] Inventor: Michael J. Zbriger, Trumbull, Conn.

[73] Assignee: Black & Decker Inc., Newark, Del.

[21] Appl. No.: 781,873

[22] Filed: Jan. 10, 1997

[51] Int. Cl.[6] ..... D06F 75/18

[52] U.S. Cl. ..... 38/77.83

[58] Field of Search ..... 38/77.83, 77.7, 38/88, 77.8, 93; 219/245, 254, 250

[56] References Cited

U.S. PATENT DOCUMENTS

| | | | |
|---|---|---|---|
| 2,906,043 | 9/1959 | Jepson et al. | 38/77.83 X |
| 3,001,305 | 9/1961 | Sardeson | 38/77.7 X |
| 3,691,660 | 9/1972 | Gronwick et al. | 38/77.83 |
| 3,828,452 | 8/1974 | Eaton et al. | 38/77.83 |
| 4,017,988 | 4/1977 | Coggiola | 38/77.83 |
| 4,091,551 | 5/1978 | Schaeffer | 38/77.83 |
| 4,240,217 | 12/1980 | Schwob | 38/77.83 |
| 4,277,900 | 7/1981 | Gowdy | 38/77.83 |
| 4,345,389 | 8/1982 | Balchunas | 38/77.7 |
| 4,414,766 | 11/1983 | Schwob | 38/77.83 |
| 5,115,117 | 5/1992 | Amiot et al. | 219/254 |
| 5,367,799 | 11/1994 | Wilson et al. | 38/77.7 |

*Primary Examiner*—Ismael Izaguirre
*Attorney, Agent, or Firm*—Barry E. Deutsch

[57] ABSTRACT

A steam iron having a soleplate, a thermostat mounted to the soleplate, and means for delivering water onto the soleplate for conversion into steam. The soleplate has a ramp extending down and away from the thermostat towards a water containment wall. The water containment wall forms a puddle area between the ramp and the water containment wall. The soleplate also has a steam surge drying wall located past the water containment wall. The drying wall is located directly between and separating exits from a surge steam area of the soleplate. The drying wall converts water, entrained in the surge steam, into steam.

14 Claims, 4 Drawing Sheets

STEAM IRON WITH STEAM CHAMBER RAMP, PUDDLE CONTAINMENT, AND SURGE DRYING WALL

BACKGROUND OF THE INVENTION

1. Field of the Invention

The present invention relates to steam irons and, more particularly, to an iron with a system to maximize steam visibility and minimize water spotting.

2. Prior Art

U.S. Pat. No. 5,367,799 discloses a steam iron with a soleplate having a surge steam area surrounding a main boiler area. The main boiler area has upstanding fins. U.S. Pat. No. 4,240,217 discloses a downwardly sloping boss under a water drop point onto a soleplate. U.S. Pat. No. 5,115,117 discloses a partition between a main vaporization chamber and an intermediate vaporization chamber.

SUMMARY OF THE INVENTION

In accordance with one embodiment of the present invention, a steam iron is provided having a soleplate, a thermostat connected to the soleplate and a system for delivering water onto a main boiler area of the soleplate for conversion into steam. The improvement comprises the soleplate having a ramp extending down and away from the thermostat and a water containment wall located between the ramp and an exit from the main boiler area. The system for delivering water delivers water directly onto the ramp and the water containment wall forms a puddle area between the ramp and the containment wall for water to collect in a puddle at a localized relatively cool area of the soleplate.

In accordance with another embodiment of the present invention, a steam iron is provided having a soleplate with a main boiler area, a surge steam area, and a connecting area connecting an exit of the main boiler area and exits of the surge steam area with a distribution area having holes to distribute steam to a bottom of the soleplate. The improvement comprises the soleplate having a surge drying wall in the connecting area. The surge drying wall is located directly between and separating the surge steam area exits from each other. The steam exiting the surge steam area exits impinges upon the surge drying wall and is redirected by the surge drying wall such that water entrained in the steam from the surge steam area can be turned into steam at the surge drying wall.

In accordance with another embodiment of the present invention, a steam iron is provided having a soleplate, means for heating the soleplate, a thermostat mounted to the soleplate and means for delivering water onto the soleplate for conversion into steam. The steam iron comprises a ramp and a steam surge drying wall. The ramp is located at a main boiler area. The ramp extends down and away from the thermostat towards a water containment wall on the soleplate. The means for delivering water onto the soleplate delivers the water directly onto the ramp. The steam surge drying wall on the soleplate is located past the water containment wall and is located directly between and separating exits from a surge steam area of the soleplate. The surge steam area is located separate from the main boiler area with the exits located past the water containment wall.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
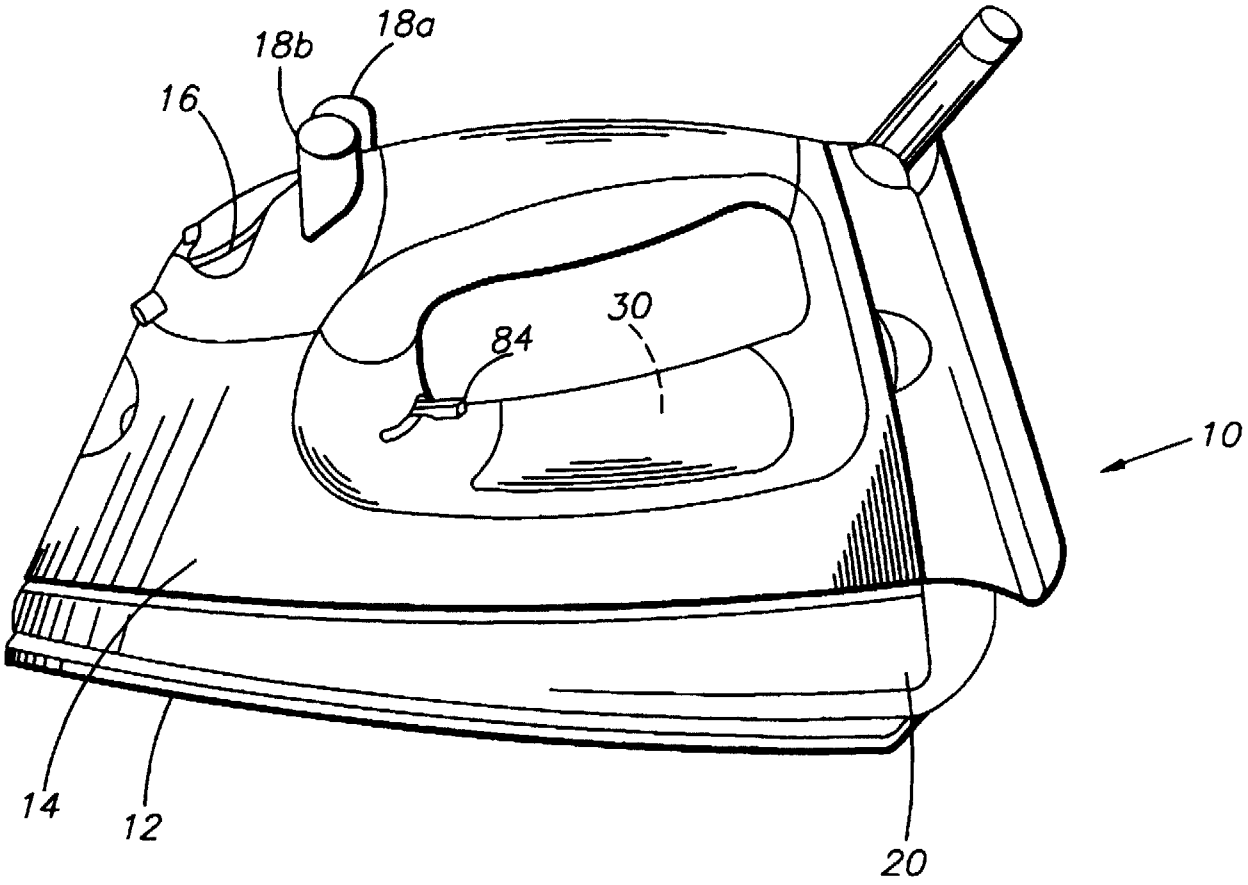
FIG. 1 is a perspective view of an iron incorporating features of the present invention.

Referring to FIG. 1, there is shown a perspective view of a steam iron 10 incorporating features of the present invention. Although the present invention will be described with reference to the iron shown in FIG. 1, it should be understood that features of the present invention can be embodied in various different alternate embodiments of steam irons. In addition, any suitable size, shape or type of elements or materials could be used.

The iron 10 generally comprises a soleplate 12, a housing 14, a temperature control knob 16, a spray button **18*a* and a surge button 18*b*. A water tank with a reservoir 30 is located in the housing 14. In the embodiment shown, the iron also has a selector 84 for choosing the mode of operation of the iron 10. Selector 84 is pivotably mounted to the housing 14. The selector 84** may be operated to select a dry (non-steam) mode, a steam mode, or a self-cleaning mode of operation.

Figure 2:
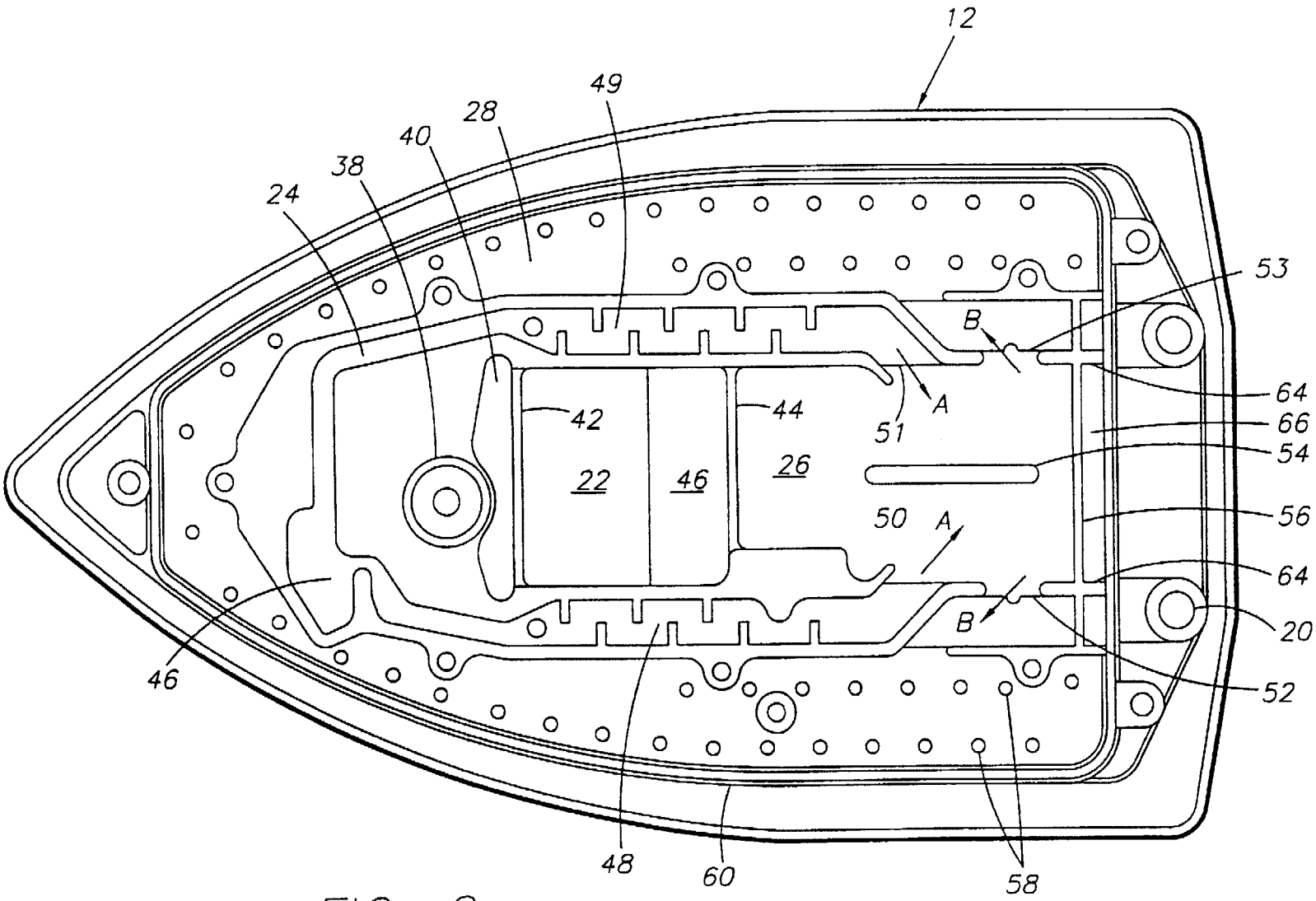
FIG. 2 is a top plan view of the soleplate used in the iron shown in FIG. 1.
Figure 3:
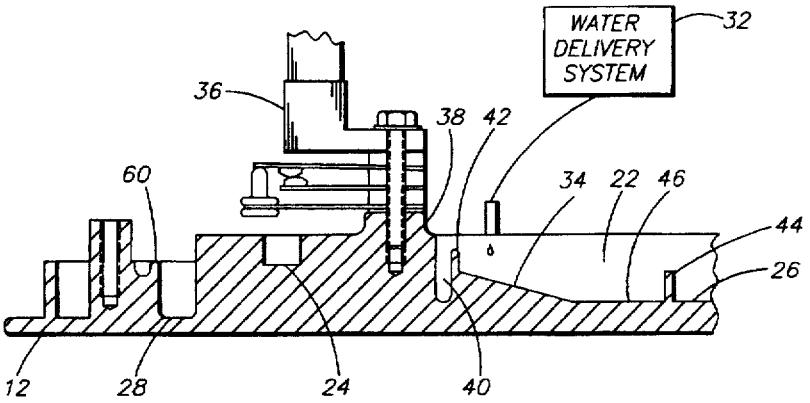
FIG. 3 is a cross-sectional view of a front portion of the soleplate shown in FIG. 2 with the thermostat attached to the soleplate and schematically showing the water delivery system.

Referring also to FIG. 2 a top plan view of the soleplate 12 is shown. The soleplate 12 includes a unitary metal member with a heating element 20 embedded therein. The soleplate 12 includes a main boiler area 22, a surge steam area 24, a connecting area 26, and a distribution area 28. Referring also to FIG. 3, an entry from the water delivery system 32 of the iron is located above the main boiler area 22 to drop water into the area 22 for generation into steam. In the embodiment shown, the main boiler area 22 has a bottom surface with a ramp 34. The ramp 34 extends down and away from the thermostat 36. The thermostat 36 is mounted to a boss 38 of the soleplate in front of the main boiler area 22. An air gap 40 and a splash wall 42 are also located between the area of the soleplate with the thermostat boss 38 and the ramp 34. This helps to thermally separate the soleplate at the main boiler area from the boss 38. Located at the rear of the main boiler area 22 is a puddle containment wall 44. The wall 44 helps to define a puddle area 46 between the ramp 34 and the wall 44. Steam exits from the main boiler area 22 above the wall 44 and into the connecting area 26.

Surrounding the main boiler area 22, but separate therefrom, is the surge steam area 24. The surge steam area 24 extends above the top of the heating element 20 along a majority of its length. The surge steam area 24 has a water receiving area 46 where water is deposited onto the soleplate, two steam paths 48, 49, and two exits 50, 51. The exits 50, 51 exit into the connecting area 26 at locations past the exit from the main boiler area. The connecting area 26 includes two exits 52, 53, a surge steam drying wall 54, and an elevated rear wall 56. The two exits 52, 53 connect the connecting area 26 to the distribution area 28 along a path over the heating element 20. The exits 52, 53 are located behind or downstream from the surge steam area exits 50, 51. The surge steam drying wall 54 is located directly between and separates the surge steam area exits 50, 51 from each other. Steam from the surge steam area exits 50, 51 is directed towards the drying wall 54 as indicated by arrows A. The surge steam area exits 50, 51 are located relatively far past the exit from the main boiler area 22 to prevent the surge steam from entraining water out of the main boiler area which might otherwise cause water spotting problems. The drying wall 54 is a single upstanding fin. The surge steam from the exits 50, 51 impinges upon the drying wall 54 such that water entrained with the surge steam can be turned into steam at the drying wall 54. The wall 54 also redirects the surge steam which turns about 180° to exit through the exits 52, 53 as shown by arrows B. When steam enters the distribution area 28 it can exit to the bottom surface of the soleplate 12 through the holes 58.

Figure 4:
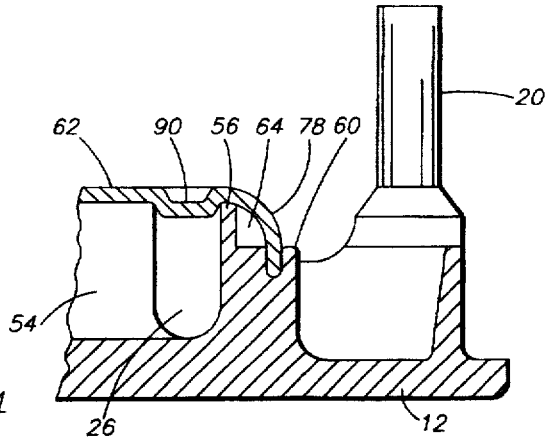
FIG. 4 is a cross-sectional view of the rear end of the soleplate shown in FIG. 2 with the steam chamber cover attached to the soleplate.
Figure 5:
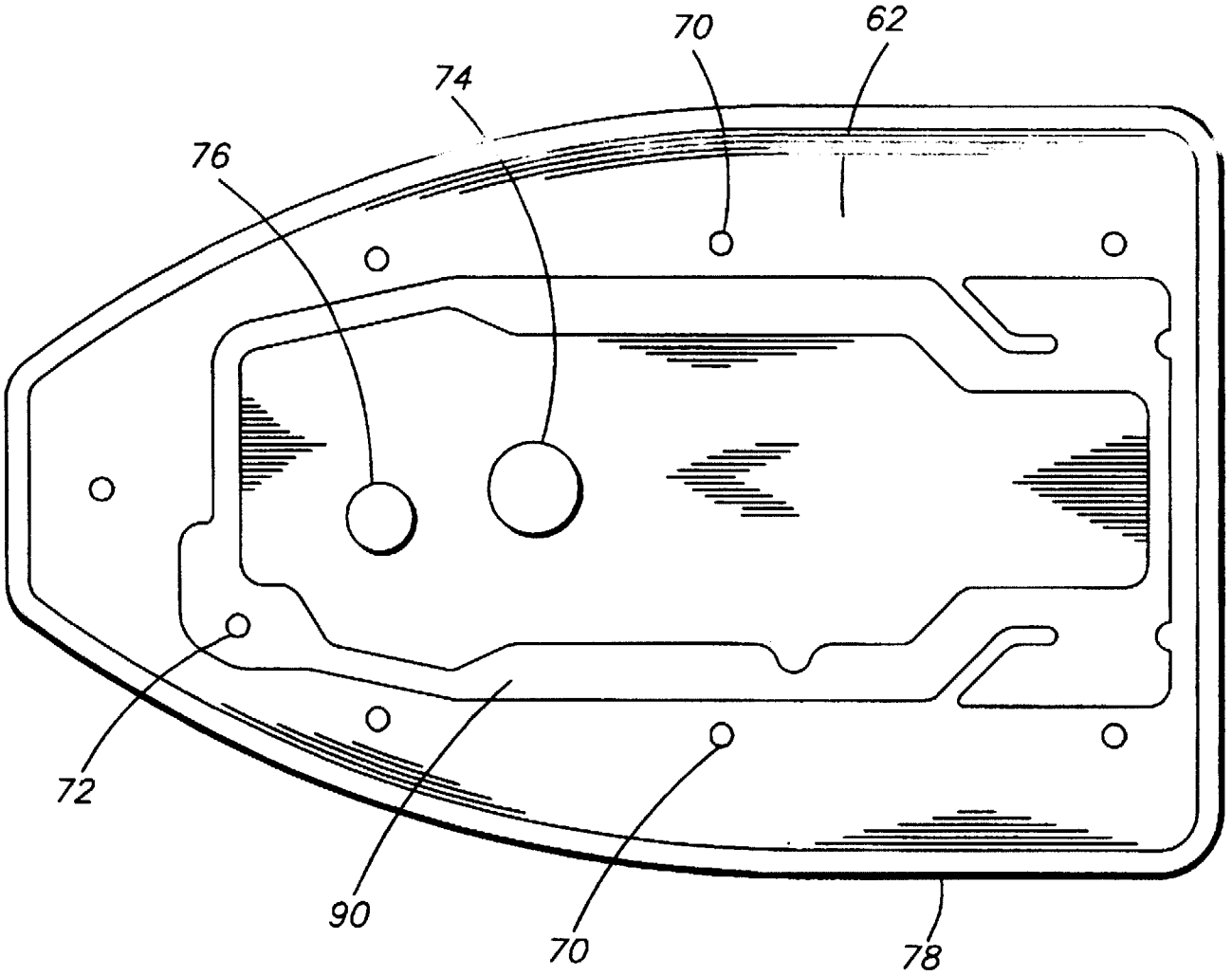
FIG. 5 is a top plan view of the steam chamber cover.

The steam chamber of the iron 10, which includes all four areas 22, 24, 26 and 28, is formed within a steam chamber wall 60 of the soleplate 12. A steam chamber cover 62 (see FIGS. 4 and 5) is attached to the top of the wall 60. Referring also to FIGS. 4 and 5, the elevated rear wall 56 is spaced from the steam chamber wall 60. The steam chamber cover 62 is a sheet metal member with mounting holes 70, two water entry holes 72, 74, a thermostat boss hole 76, and a downwardly sloping outer perimeter rim 78. The soleplate 12 also has two elevated rear side walls 64. The walls 64 have curved top surfaces to form a transition from the top of the elevated rear wall 56 to the steam chamber wall 60 behind the elevated rear wall 56. With the steam chamber cover 62 attached to the steam chamber wall 60, the cover 62 contacts the top surfaces of the elevated rear wall 66 and the elevated rear side walls 64. This forms a pocket 66 at the rear end of the steam chamber. When the iron 10 is stood up onto its back or heel, water in the puddle area 46 can flow past the puddle containment wall 44 towards the elevated rear wall 56. When the cover 62 is attached to the soleplate 12 it is stamped or indented along area 90. This prevents water or steam from passing between the cover and the top surfaces of the walls adjacent the area 90.

One of the objects of the present invention is to maximize steam visibility, but nonetheless minimize water spotting. In order to maximize steam visibility, water needs to be transformed into steam at a relatively low temperature. Water which is transformed into steam at a relatively low temperature generates a more visible steam than at a higher temperature. However, the iron still needs to be hot enough to generate surge steam without water spotting. Thus, in order to provide both a low temperature for maximum steam visibility and a high temperature for surge steam generation without water spotting, the iron 10 is provided with a unique main boiler area. Water droplets from the water delivery system 32 drip down onto the ramp 34. Water which is not immediately turned into steam travels down the ramp 34 and into the puddle area 46. By keeping the puddle in the area 46 contained in a small area, bounded bar the ramp 34, sidewalls and the puddle containment wall 44, a relatively cool localized area is created for the generation of visible steam. The ramp 34 also directs the water droplets away from the thermostat 36. This effectively fools the thermostat to stay OFF longer since the cooler water is moved away from the thermostat. With the thermostat OFF longer, less heat is pumped into the soleplate. This allows the puddle to stay larger which, in turn, creates more visible steam. The ramp 34 also directs the water to the center of the soleplate 12. This cools the back of the soleplate. This, in turn, brings the temperature down at the rear of the soleplate which also increases steam visibility. In an alternate embodiment of the present invention, the ramp 34 may be a separate part not molded into the soleplate.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a steam iron having a soleplate, a thermostat connected to the soleplate, and a system for delivering water onto a main boiler area of the soleplate for conversion into steam, wherein the improvement comprises:

the soleplate having a ramp extending down and away from the thermostat and a water containment wall located between the ramp at an exit from the main boiler area and a longitudinally extending connecting area downstream from the containing wall that connects the main boiler area to a steam distribution area, said connecting area having at least one steam exit downstream of said containment wall communicating with the steam distribution area wherein the system for delivering water delivers water directly onto the ramp and the water containment wall forms a puddle area between the ramp and the containment wall for water to collect in a puddle at a localized relatively cool area of the soleplate.

2. An iron as in claim 1 further comprising means for cooling a rear of the soleplate comprising the puddle area being located in a center of the soleplate.

3. An iron as in claim 1 further comprising the ramp directing water away from the thermostat to minimize impingement of water on said thermostat to thereby allow the thermostat to stay OFF longer.

4. An iron as in claim 1 further comprising a steam surge drying wall on the soleplate located in the connecting area past the water containment wall and located directly between and separating exits from a surge steam area of the soleplate, the surge steam area being located separate from the main boiler area with the exits located past the water containment wall.

5. In a steam iron having a soleplate with a main boiler area, a surge steam area, and a connecting area connecting an exit of the main boiler area and exits of the surge steam area with a distribution area having holes to distribute steam to a bottom of the soleplate, wherein the improvement comprises:

the soleplate having a surge drying wall in the connecting area, the surge drying wall being located directly between and separating two of the surge steam area exits from each other, wherein steam exiting the surge steam area exits impinges upon the surge drying wall and is redirected by the surge drying wall such that water entrained in the steam from the surge steam area is turned into steam at the surge drying wall, said soleplate further including a ramp extending down and away from a thermostat connected to the soleplate and a water containment wall located between the ramp and said surge drying wall.

6. An iron as in claim 5 wherein the surge drying wall comprises a single straight fin extending upward from the soleplate.

7. An iron as in claim 5 wherein the soleplate has two opposite paths extending from the connecting area to the distribution area, the paths being located behind the surge steam area exits such that steam exiting the surge steam area exits is redirected about 180° before entering respective paths on each side of the surge drying wall.

8. An iron as in claim 5 wherein the iron further comprises a system for delivering water directly onto the ramp and wherein the water containment wall forms a puddle area between the ramp and the containment wall for water to collect in a puddle at a localized relatively cool area of the soleplate.

9. A steam iron having a soleplate, means for heating soleplate, a thermostat mounted to the soleplate, and means for delivering water onto the soleplate for conversion into steam, the steam iron comprising:

a ramp on the soleplate at a main boiler area, the ramp extending down and away from the thermostat towards a water containment wall on the soleplate, the means for delivering water onto the soleplate delivering the water directly onto the ramp; and a steam surge drying wall on the soleplate located past the water containment wall and located directly between and separating exits from a surge steam area of the soleplate, the surge steam area being located separate from the main boiler area with the exits located past the water containment wall.

10. An iron as in claim 9 wherein the water containment wall forms a puddle area between the water containment wall and the ramp.

11. An iron as in claim 10 further comprising means for cooling a rear of the soleplate comprising the puddle area being located in a center of the soleplate.

12. An iron as in claim 9 further comprising means for increasing visibility of steam from the iron comprising the ramp directing water away from the thermostat to thereby allow the thermostat to stay OFF longer.

13. An iron as in claim 9 wherein the surge drying wall comprises a single straight fin extending upward from the soleplate.

14. An iron as in claim 9 wherein the soleplate as two opposite paths extending from a connecting area having the surge drying wall to a distribution area, the paths being located behind the surge steam area exits such that steam exiting the surge steam area exits is redirected about 180° before entering respective paths on each side of the surge drying wall.

* * * * *